US008662815B2

(12) United States Patent
Magni

(10) Patent No.: US 8,662,815 B2
(45) Date of Patent: Mar. 4, 2014

(54) GRIPPING ORGAN FOR LOAD-MOVING VEHICLES

(75) Inventor: Riccardo Magni, Modena (IT)

(73) Assignee: Manitou Italia S.R.L., Castelfranco Emilia (IT)

( * ) Notice: Subject to any disclaimer, the term of this patent is extended or adjusted under 35 U.S.C. 154(b) by 589 days.

(21) Appl. No.: 12/999,588

(22) PCT Filed: May 20, 2009

(86) PCT No.: PCT/IB2009/052104

§ 371 (c)(1),
(2), (4) Date: Dec. 16, 2010

(87) PCT Pub. No.: WO2010/007541

PCT Pub. Date: Jan. 21, 2010

(65) Prior Publication Data

US 2011/0103927 A1 May 5, 2011

(30) Foreign Application Priority Data

Jul. 14, 2008 (IT) ..... MO2008A0192

(51) Int. Cl.

| | |
|---|---|
| ***B66C 3/00*** | (2006.01) |
| ***B66C 1/42*** | (2006.01) |
| ***B66C 1/58*** | (2006.01) |
| ***E02F 3/96*** | (2006.01) |
| ***E02F 3/04*** | (2006.01) |

(52) U.S. Cl.
USPC ..... 414/620; 414/10; 414/739; 901/29; 405/184.5

(58) Field of Classification Search
USPC ..... 294/81.61, 86.27, 86.32, 86.41; 405/184.5; 414/11, 23, 24, 590, 618, 414/620, 639, 729, 732, 736, 738, 739, 414/745.1, 745.2, 745.4, 745.5, 745.6; 901/2, 27–29, 31, 37
See application file for complete search history.

(56) References Cited

U.S. PATENT DOCUMENTS

| | | | | | |
|---|---|---|---|---|---|
| 3,409,158 | A | * | 11/1968 | Lull | 414/639 |
| 4,561,176 | A | * | 12/1985 | Leddet | 29/709 |
| 4,682,926 | A | * | 7/1987 | Chambers et al. | 414/11 |
| 4,696,503 | A | * | 9/1987 | Collodel | 294/207 |
| 4,778,329 | A | * | 10/1988 | Phillips | 414/589 |
| 4,789,417 | A | * | 12/1988 | Komatsu et al. | 156/356 |
| 5,207,554 | A | * | 5/1993 | Asakawa et al. | 414/744.6 |

(Continued)

FOREIGN PATENT DOCUMENTS

| | | | |
|---|---|---|---|
| DE | 3834311 | A * | 4/1990 |
| FR | 2848200 | | 6/2004 |

(Continued)

*Primary Examiner* — Gregory Adams
(74) *Attorney, Agent, or Firm* — Pearne & Gordon LLP

(57) ABSTRACT

A gripping organ for load-moving vehicles comprises a support structure (7), removably engageable to a support arm (4) of a load-moving vehicle (2); at least gripping pliers (8), operatively engaged to the support structure (7) and predisposed to engage at least an object (P) to be moved, the gripping pliers (8) comprising at least a pair of gripping elements (16) which are mobile between an operating position, in which the gripping elements (16) engage the object (P), and a non-operating position, in which the gripping elements (16) are disengaged from the object (P); the pliers (8) being translatable along a translating direction (A) and rotatable about a rotation axis (B) which is perpendicular to the translating direction (A).

11 Claims, 3 Drawing Sheets

(56) References Cited

U.S. PATENT DOCUMENTS

| | | | | |
|---|---|---|---|---|
| 5,762,391 | A * | 6/1998 | Sumnitsch | 294/119.1 |
| 5,795,101 | A * | 8/1998 | Bill | 405/184.5 |
| 6,280,119 | B1 * | 8/2001 | Ryan et al. | 405/156 |
| 6,418,644 | B1 | 7/2002 | Bykov et al. | |

FOREIGN PATENT DOCUMENTS

| | | | |
|---|---|---|---|
| JP | 02132100 | | 5/1990 |
| RU | 2002054 | C1 | 10/1993 |
| RU | 2135699 | C1 | 8/1999 |
| SU | 1253950 | A2 | 8/1986 |
| WO | 2005123564 | | 12/2005 |

* cited by examiner

GRIPPING ORGAN FOR LOAD-MOVING VEHICLES

TECHNICAL FIELD

The invention relates to a gripping organ for load-moving vehicles.

In particular, the present invention is advantageously applied in movement of hydraulic cylinders of earth-moving machines.

In more detail, the present invention is advantageously applied in the movement of hydraulic cylinders for earth-moving machines used in mines and/or open quarries or the like.

BACKGROUND ART

In the technical field, earth-moving machines of considerable dimensions are used for transporting enormous quantities of earth and/or rocks.

These machines are generally tracked digger machines comprising a scoop or bucket connected to the rest of the machine by an extensible articulated arm. The arm is composed by a plurality of portions which are moved by means of corresponding hydraulic actuators.

The actuators, proportionally to the machine, exhibit considerable dimensions and weight. By way of example, an actuator used for moving the articulated arm of these earth-moving machines can be several meters long and have a diameter in the order of tens of centimeters.

Further, the actuators can be located in decidedly difficult positions and can be orientated in various directions.

Periodically the actuators of known earth-moving machines have to be dismounted in order to be subjected to ordinary cleaning and/or maintenance operators.

The machines operate in very dusty environments and frequently the actuators are subject to infiltrations of earth or other impurities, which rapidly leads to a loss in functionality.

The dismounting operations of the actuators are especially complex and dangerous.

It is in fact necessary first to support them such that it is possible to remove them from the machine in all safety. This operation is normally done by securing the actuators to a lift by means of ropes or belts.

Following this, specially-trained operatives remove the mechanical and hydraulic connections between the machine and the actuators.

When the actuators are completely dissociated from the machine, the actuators are distanced therefrom by use of the lift.

Obviously this is a very slow and laborious process due to the need to stably secure the actuators which, as mentioned, are particularly unwieldy and heavy.

Further, the described dismounting operations of the actuators present not inconsiderable risks for the safety of the operatives.

In this context, the technical task of the present invention is to provide a gripping organ for load-moving vehicles which is free of the above-described drawbacks.

In particular, the aim of the present invention is to provide a gripping organ for load-moving vehicles which enables rapid and easy grip and movement of the loads.

A further aim of the invention is to provide a gripping organ for load-moving vehicles which enables secure grip and movement of loads.

In more detail, an aim of the present invention is to provide a gripping organ for load-moving vehicles which enables rapid, easy and safe removal of hydraulic actuators of earth-moving machines used in mines and/or open quarries.

In the present invention, the technical task and the aims described above are attained by a gripping for load-moving vehicles comprising the technical characteristics set out in one or more of the appended claims.

DISCLOSURE OF INVENTION

Further characteristics and advantages of the present invention will better emerge from the following non-limiting description of a preferred but not exclusive embodiment of a gripping organ for load-moving vehicles, as it is illustrated in the accompanying figures of the drawings, in which.

Figure 2:
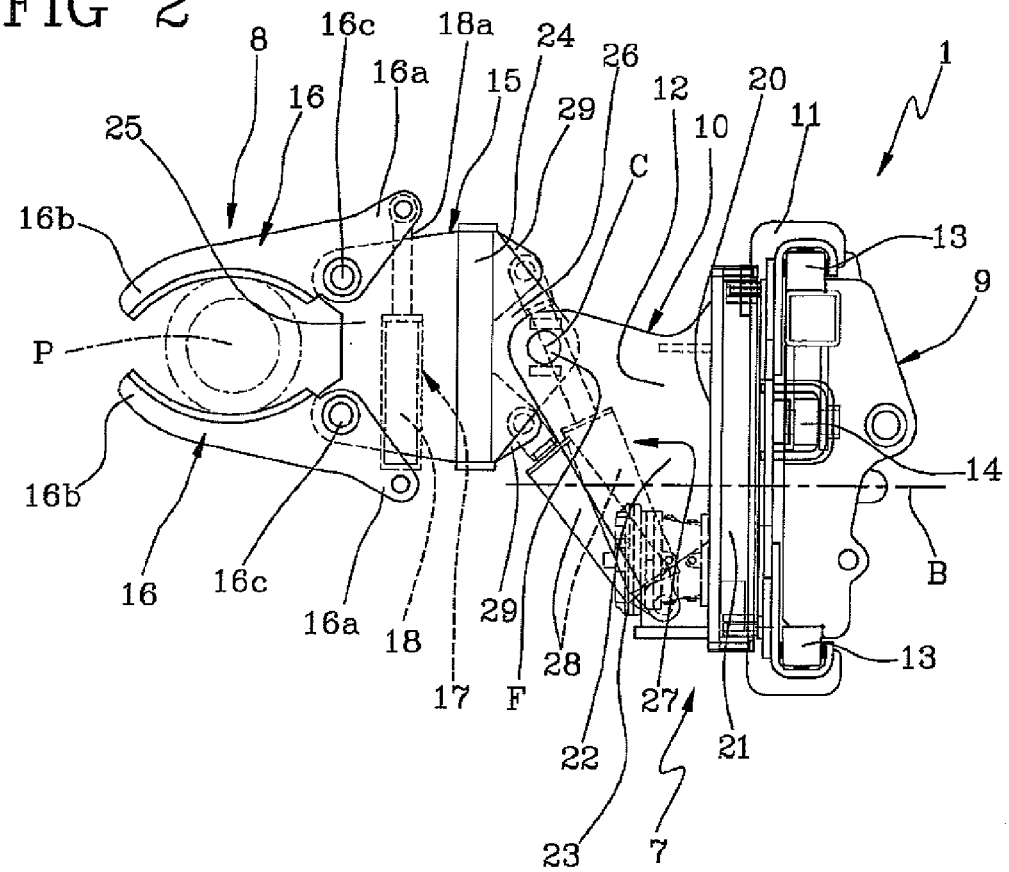
FIG. 2 is a lateral view of a gripping organ for load-moving vehicles of the present invention.
Figure 2A:
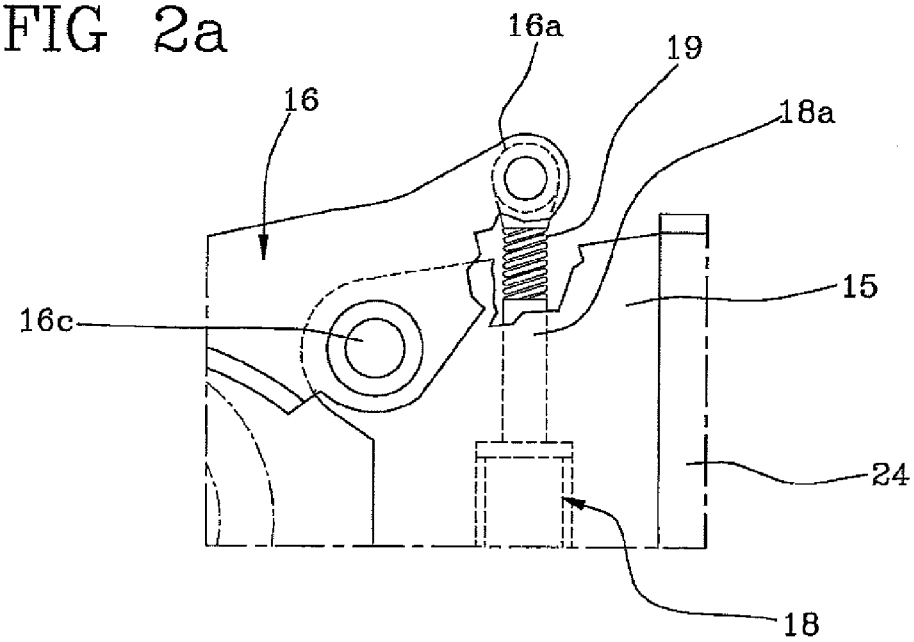

FIG. 2*a* is an enlarged detail of FIG. 2; and

Figure 1:
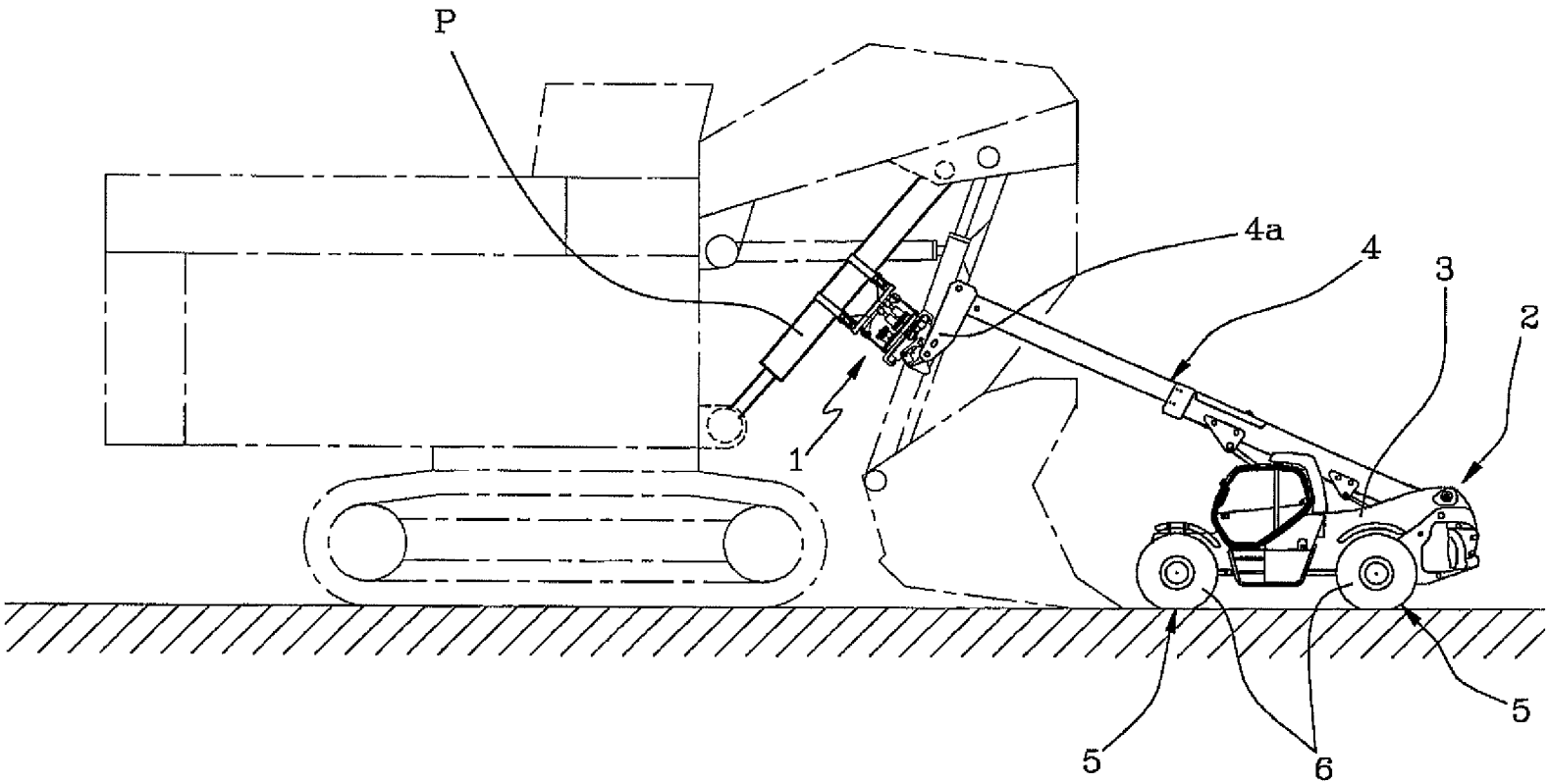
FIG. 1 illustrates a lateral view of a load-moving vehicle comprising the gripping organ of FIG. 2.
Figure 3:
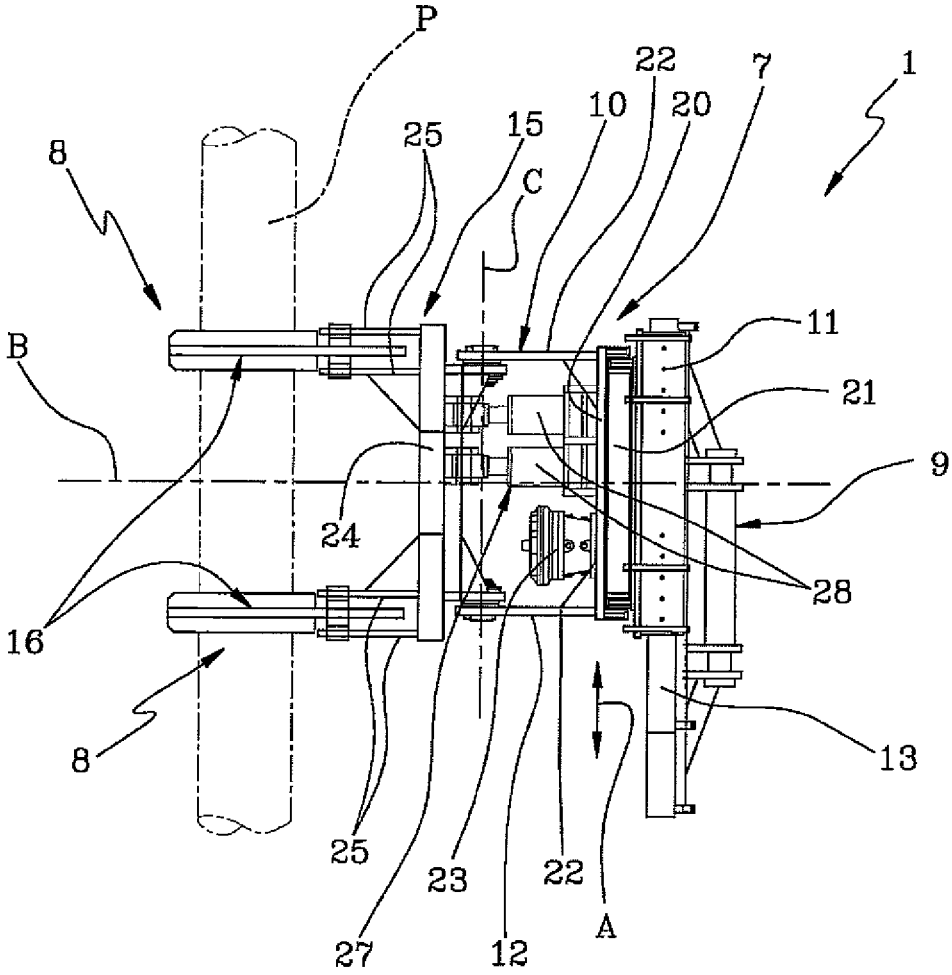

FIG. 3 is a plan view of the gripping organ for load-moving vehicles of FIG. 1.

With reference to the figures of the drawings, 1 denotes in its entirety a gripping organ for load-moving vehicles.

In FIG. 1, the gripping organ 1 is operatively associated to a load-moving vehicle 2.

In detail, the vehicle 2 comprises a frame 3 and a mobile and telescopic support arm 4 constrained to the frame 3 of the vehicle 2 and predisposed to support a predetermined weight.

Special locomotive means 5 are associated to the frame to enable the vehicle 2 to move on the operating terrain.

In the illustrated embodiment, the locomotive means 5 comprise a motor (not illustrated in the figures) and a plurality of wheels 6. Alternatively the locomotive means 5 comprise tracks for moving the vehicle more easily.

In particular, the gripping organ 1 is connected to the arm 4 of the vehicle 2.

The gripping organ 1 comprises a support structure 7 which is removably associable to the support arm 4 of the vehicle 2 and gripping pliers 8 associated to the support structure 7 and predisposed to engage at least an object P to be supported and/or moved.

In the described embodiment, the object P to be supported and/or moved is for example a hydraulic cylinder of an earth-moving machine engaged in mines and/or open quarries or the like.

In greater detail, the support structure 7 comprises a joint 9 which is connected rigidly to a free end 4*a* of the arm 4.

The support structure 7 further comprises a carriage 10 slidably associated to the joint 9 and translatable with respect thereto along a translation direction A. The pliers 8 are supported on the carriage such that the pliers 8 are translatable along the translation direction A.

The carriage 10 comprises a skate 11 connected slidably to the joint 9 and a support body 12 rotatably connected to the skate about a rotation axis B. In more detail the pliers 8 are supported by the support body 12 of the carriage 10. In this way, the pliers 8 can rotate with respect to the skate 11 about the rotation axis B.

The joint 9 comprises two straight and parallel guides 13 on which the skate 11 of the carriage 10 slides. The guides 13 are arranged parallel to the translation direction A.

Further, special means for moving 14 are interposed between the carriage 10 and the joint 9 of the support structure 7. In particular, the means for movement 14 are arranged between the joint 9 and the skate 11 and are active thereon in order to cause translation of the carriage 10 and thus of the support body 12 and the pliers 8.

The support body 12 of the carriage 10 comprises a main plate 20 arranged substantially perpendicular to the rotation axis B and coupled to a fifth wheel 21 arranged on the joint 9. A pair of plates 22 develop starting from the plate 20 such as to lie perpendicular to the plate 20 and parallel to one another. As will emerge more clearly herein below, the pliers 8 are connected to the support body 12 via the plates 22.

A special motor 23 is associated to the truck 10 such as to enable rotation of the support body 12. The motor 23, solidly constrained to the support body 12, is located between the plates 22 of the body 12. The motor 23 can be electric or hydraulic.

In detail, the pliers 8 are rotatably connected to the support body 12 such as to be able to oscillate with respect to the support body 12 about an oscillating axis C arranged perpendicular to the rotation axis B.

The pliers 8 comprise a main body 15 constrained oscillatingly to the support body 12 of the carriage 10 and a pair of gripping elements 16 rotatably associated to the main body 15. In particular, the main body 15 is connected to the plates 22 of the support body 12 of the carriage 10.

With reference to the preferred embodiment, the pliers 8 comprise two pairs of gripping elements 16 associated two-by-two and mobile in reciprocal nearing and/or distancing between an operating position in which the gripping elements 16 are in contact with the object P and engage it in order to support it and/or move it, and a non-operating position in which they are disengaged from the object P.

The pairs of gripping elements 16 are arranged on parallel planes and specially distanced. The pliers 8 can, therefore, grip the object P in at least two distinct and distanced points such as to grip and manoeuvre the object P stably and reliably.

The gripping elements 16 exhibit an elongate and curved shape and exhibit respective ends 16*a* in proximity of the main body 15 and ends 16*b* which are distant from the main body 15.

The gripping elements 16 are hinged to the main body 15 at respective pivots 16*c* located between the proximal ends 16*a* and the distal ends 16*b* of the gripping elements 16.

The pliers 8 further comprise activating means 17 acting on the gripping elements 16 in order to displace them between the operating position and the non-operating position.

In the preferred embodiment, the activating means 17 comprise a respective hydraulic actuator 18 connected between the proximal ends 16*a* of each pair of gripping elements 16 of the pliers 8.

The pliers 8 further comprise at least an elastic element 19 located between each actuator 18 and at least one of the gripping elements 16 of each couple. In particular, the elastic element 19 is located between an end 18*a* of each actuator 18 and the proximal end 16*a* of one of the gripping elements 16 of each pair. By way of example, the elastic element 19 is a spring.

The elastic element 19 advantageously enables limiting the transmission of undesired actions from the gripping elements 16 to the rest of the pliers 8. The main body 15 of the pliers 8 comprise a flat plate 24 from which a pair of plates 25 develop, which plates 25 are perpendicular to the flat plate 24 and parallel to one another. These plates 25 of the main body 15 of the pliers 8 are hinged to the plates 22 of the support body 12 of the carriage 10. In this way, the main body 15 of the pliers 8 can oscillate about the oscillating axis C.

The main body 15 of the pliers 8 further comprises two pairs of brackets 26 which develop perpendicularly starting from the flat plate 24 of the main body 15 on the opposite side from the plates 25.

Each pair of gripping elements 16 is hinged to a corresponding pair of brackets 26 at the respective pivots 16*c*.

The gripping organ 1 further comprises motor means 27 acting on the pliers 8 to oscillate it and bring it into a desired orientation about the oscillation axis C.

In particular, the motor means 27 comprise at least an actuator 28 located between the support body 12 of the carriage 10 and the main body 15 of the pliers 8.

In more detail still, the motor means 27 comprise two actuators 28 acting on the main body 15 of the pliers 8 at different points and reciprocally opposite with respect to a pivotal point F between the main body 15 and the support body 12.

In detail, the main body 15 of the pliers 8 comprises two wings 29 which extend perpendicular to the flat plate 24 of the main body 15 and are on an opposite side to the pivotal point F.

Each actuator 28 is thus connected to a respective wing 29. In this configuration, when it is necessary to incline the pliers 8 to make the pliers 8 assume a desired inclination, both the actuators 28 act on the main body 15 of the pliers 8 such as to make the operation simpler.

Both the actuators 28 are comprised between the plates 22 of the support body 12.

The invention attains the set aims and offers important advantages.

The gripping organ of the present invention enables movement of objects very simply and safely.

As the pliers are both translatable and rotatable, objects can be moved in many directions.

With particular reference to earth-moving machines used in mines and/or open quarries, the gripping organ of the present invention enables the hydraulic actuators moving these machines to be moved stably and securely.

The operations necessary for dismounting the actuators in order to subject them to cleaning and/or maintenance operations are thus enormously simplified and expedited.

The gripping organ of the invention also enables these operations to be carried out with a high degree of safety for the operators involved in operations.

The invention claimed is:

1. A gripping organ for load-moving vehicles, comprising:

a support structure (7), removably engageable to a support arm (4) of a load-moving vehicle (2);

at least gripping pliers (8), operatively engaged to the support structure (7) and predisposed to engage at least an object (P) to be moved, the gripping pliers (8) comprising at least a pair of gripping elements (16) which are mobile between an operating position, in which the gripping elements (16) engage the object (P), and a non-operating position, in which the gripping elements (16) are disengaged from the object (P);

the support structure (7) comprises a joint (9) rigidly associable to the arm (4) and a carriage (10) which is slidably associated to the joint (9) and supports the pliers (8) whereby the pliers (8) are translatable along a translating direction (A);

the carriage (10) comprises a support body (12) to which the pliers (8) and a skate (11) are connected, the skate (11) being rotatably connected to the support body (12) and slidably associated to the joint (9); the support body (12) being rotatable about the rotation axis (B) with respect to the skate (11) in order to rotate the pliers (8) whereby the pliers (8) are rotatable about a rotation axis (B) which is perpendicular to the translating direction (A);

the pliers (8) comprise at least a main body (15) constrained oscillatingly to the support body (12); the gripping elements (16) being rotatably constrained to the main body (15), whereby the pliers (8) are rotatably fixed to the support body (12) in order to oscillate about an oscillating axis (C) which is perpendicular to the rotation axis (B).

2. The gripping organ of claim 1, characterised in that the joint (9) comprises at least a guide (13) on which the carriage runs (10).

3. The gripping organ of claim 2, characterised in that the joint (9) comprises two straight and parallel guides (13) on which the carriage runs (10), the guides (13) being arranged parallel to the translating direction (A).

4. The gripping organ of claim 1, characterised in that it comprises means for moving (14) the carriage (10), the means for moving (14) acting between the joint (9) and the support body (12).

5. The gripping organ of claim 4, characterised in that the pliers (8) comprise activating means (17) acting between the gripping elements (16) in order to move the gripping elements (16) between the operating position and the non-operating position.

6. The gripping organ of claim 1, characterised in that the gripping elements (16) of the pliers (8) are elongate and exhibit respective ends (16*a*) proximal to the main body (15); the activating means (17) comprising a hydraulic actuator (18) acting between the proximal ends (16*a*).

7. The gripping organ of claim 6, characterised in that the pliers (8) comprise at least an elastic element (19) located between the actuator (18) and the gripping element (16).

8. The gripping organ of claim 1, characterised in that it comprises two pairs of gripping elements (16); the gripping elements (16) being arranged two-by-two on parallel and distanced planes.

9. The gripping organ of claim 1, characterised in that it comprises motor means (27) connected to the support body (12) and acting on the main body (15) of the pliers (8) in order to orientate the pliers (8) about the oscillating axis (C).

10. The gripping organ of claim 1, characterised in that the support body (12) comprises a plate (20) which is rotatably associated to a fifth wheel (21) of the skate (11) and two plates (22) which are parallel to one another and connected to the plate (20).

11. A load-moving vehicle, comprising:

a frame (3);

locomotive means (5) operatively associated to the frame (3) in order to enable the frame (3) to move;

at least a support arm (4), operatively engaged to the frame (3) and suitable for supporting a predetermined load;

at least a gripping organ (1) engaged to the support arm (4) and predisposed to engage at least an object (P) to be moved, characterised in that the gripping organ (1) comprises the characteristics expressed in claim 1.

* * * * *